United States Patent [19]

Brock et al.

[11] 4,052,232

[45] Oct. 4, 1977

[54] PHOSPHATING PROCESS

[75] Inventors: Michael Brock, Reading; Brian Alfred Cooke, Knotty Green, both of England

[73] Assignee: Imperial Chemical Industries Limited, Great Britain

[21] Appl. No.: 697,740

[22] Filed: June 18, 1976

[30] Foreign Application Priority Data

June 20, 1975 United Kingdom ..... 26351/75

[51] Int. Cl.[2] ..... C23F 7/10

[52] U.S. Cl. ..... 148/6.15 Z; 148/6.15 R

[58] Field of Search ..... 148/6.15 R, 6.15 Z, 148/6.16

[56] References Cited

U.S. PATENT DOCUMENTS

| | | | |
|---|---|---|---|
| 3,132,055 | 5/1964 | Tanaka | 148/6.16 |
| 3,136,663 | 6/1964 | McDonald | 148/6.15 Z |
| 3,175,964 | 3/1965 | Watanabe et al. | 148/6.16 |
| 3,941,562 | 3/1976 | Hollingshad | 21/2.7 A |

FOREIGN PATENT DOCUMENTS

| | | | |
|---|---|---|---|
| 1,303,705 | 8/1962 | France | 148/6.15 |

*Primary Examiner*—Ralph S. Kendall

*Attorney, Agent, or Firm*—Cushman, Darby & Cushman

[57] ABSTRACT

Low molecular weight water soluble polymers (molecular weight less than $5 \times 10^5$) which comprise monomer moieties selected from acrylic acid, methacrylic acid, acrylamide and methacrylamide, when present in acid metal phosphating solutions modify the physical form of sludge produced. Process efficiency is improved.

5 Claims, No Drawings

PHOSPHATING PROCESS

This invention relates to a process of applying a phosphate coating to metal substrates, more particularly to the alleviation of the harmful effect of sludge formation in such a process. The invention also relates to new phosphating solutions.

Phosphate coatings may be applied to metal substrates, notably ferrous substrates, by reaction of the substrate with an aqueous acidic solution of certain metal phosphates, e.g. phosphates of iron, manganese and zinc. There are certain by-products of the reaction with the substrate some of which are precipitated from the phosphating solution as coating proceeds. These by-products will usually include an insoluble phosphate salt of the substrate metal, for example ferric phosphate in the case of a ferrous substrate.

The precipitate is a hindrance to efficient coating since it may form a crust on the walls of the coating bath and its associated equipment, in particular heat-transfer surfaces. Also a layer of precipitate accumulates as a sludge in the bottom of the coating bath or of the reservoir of working coating solution which may be difficult to remove when its removal is desirable. A further possibility is that the phosphated work pieces may become contaminated. The formation of an insulating crust on the heat transfer surfaces located in the coating bath and, in the case of a spray process, on the spray nozzles, necessitates frequent scraping of these and other parts of the equipment in order to maintain the efficiency of the process; for example good heat transfer and temperature control.

We have now found that the precipitate which is produced in phosphating processes of the type described above can be modified in its physical form, so that it is less likely to cake into a rigid mass and has a reduced tendency to form a crust on, for example, heat transfer surfaces and spray nozzles, by the addition to the bath of certain water soluble polymers.

According to this invention we provide an improved process of applying a phosphate coating to a metal substrate by treating the substrate with an acidic metal phosphate solution in the presence of a water soluble polymer of molecular weight not greater than $5 \times 10^5$, the polymer comprising moities of monomers selected from acrylic acid, methacrylic acid, acrylamide and methacrylamide.

We have found that the polymers of this invention are responsible for a very significant decrease in the formation of crust on heating pipes and the like, whereas polymers of higher molecular weight, e.g. $8 - 15 \times 10^6$, which are otherwise similar do not significantly improve the problems associated with the formation of a precipitate as described above. There is, therefore, a very real improvement in the efficiency of the process and a decrease in the heating costs. We believe that the polymers of higher molecular weight behave as flocculants, i.e. they favour the aggregation and compaction of the precipitated by-products whereas the lower molecular weight polymers behave as dispersants. It is surprising that only these lower molecular weight polymers act to prevent the formation of a crust by maintaining the precipitate as a mobile, non-adhering, mobile, non-adhering soft sludge Preferably the effective water soluble polymer has a molecular weight of at least 150. More preferably the molecular weight of the water soluble polymer is in the range 1000 to 50,000. Particularly suitable polymers are polyacrylic acid and polyacrylamide.

A suitable polymer is a polyacrylamide of molecular weight 10–20,000. One commercially available polyacrylamide believed to be in this range of molecular weight is Versicol W 11. Another suitable polymer is the polyacrylic acid commercially available as Versicol E 5.

Preferably the phosphating solution contains at least 1 part per million (ppm) of the water soluble polymer and preferably at least 5 ppm. A suitable concentration is in the region of 50 ppm. This may be increased, for example to 100 ppm, but higher concentrations do not usually confer significant advantage. The polymer may be added separately to the phosphating solution or it may be added in admixture with the replenishment as coating proceeds.

The present process is applicable to all conventional phosphating processes, for example to spray and dip processes. Preferably it is applied to ferrous substrates.

This invention also provides a phosphating solution comprising a low molecular weight polymer as herein described for use in conventional phosphating processes. This solution may comprise any of the conventional ingredients of phosphating baths such as, for example, depolarising oxidants. The invention is particularly applicable to phosphating solutions which comprise acidic zinc phosphate.

The invention is illustrated by the following Examples in which parts and percentages are by weight:

EXAMPLE 1

The heat transfer conditions existing in an industrial phosphating bath were simulated in the laboratory by the following procedure:

4 liters of an aqueous phosphating solution were prepared which contained 1.24% Zn, 1.0% $PO_4$, and 2.4% $NO_3$, and which had a total acid pointage of 38 points (Number of mls. N/10 NaOH required to nitrate a 10 ml. sample of the solution using phenolphthalein as indicator). The phosphating solution was stirred slowly to maintain its homogeneity and its temperature maintained at 71° C by a tubular mild steel heating jacket containing a silicone oil which was heated to about 160° C by an electrically heated element. This silicone oil was stirred rapidly to ensure an even temperature over the exterior of the heating jacket.

An initial small addition of sodium nitrite toner was made to the solution (to provide a titre of 2 ml. N/10 $KMnO_4$ against 50 ml. of the solution in the presence of 50% $H_2SO_4$). A mild steel panel was passed through the phosphating solution every 15 minutes, the total time of immersion of each panel being 5 minutes. The solution was regularly replenished with a concentrate containing 11.8% Zn, 34.5% $PO_4$ and 13.9% $NO_3$ to maintain a pointage of 38 – 42 and after a total of 126 panels had been treated in the solution and the zinc content of the solution had been replaced twice.

In parallel experiments using the above procedure:

a. in which the solution contained no other additive;
b. in which the solution contained 50 ppm of Versicol W 11 (polyacrylamide having a reduced viscosity of 0.22 compared with water at 25° C which indicates a molecular weight of 10 20,000);

the following observations were made:

a. the heating jacket was coated with an adherent crust about ⅛ inch thick and the sludge (when removed by decantation and placed in a measuring cylinder to a sludge height of 20 cm.) was very fine and was virtually impenetrateable by a glass rod;

b. the heating jacket had a thin loose crust which was readily dislodged and the sludge (tested as above) was relatively mobile and could be easily penetrated by the glass rod.

EXAMPLE 2

In a conventional spray phosphating process employing a phosphating solution which contained ingredients similar to those used in Example 1, it was found that the presence of 50 ppm of Versicol W 11 significantly improved the capability of the heat exchanger and prevented the formation of the solid crust which occurred in the absence of the additive. The crust became detached in large pieces which blocked the orificer of the spray jets whereas in the presence of the additive the coating formed on the heat exchanger was relatively soft and became detached only in small pieces which did not block the orificer of the spray jets.

What we claim is:

1. A process of applying a phosphate coating to a ferrous metal substrate by treating the substrate with an acidic zinc phosphate solution and a depolarizing oxidant in the presence of 1 - 100 parts of a water soluble polymer per million parts of the phosphate solution, wherein the polymer is a polyacrylic acid or a polyacrylamide of molecular weight between 150 and $5 \times 10^5$.

2. A process according to claim 1 wherein there is present 5 to 50 parts of water soluble polymer per million parts of the phosphate solution.

3. A process according to claim 1 wherein the molecular weight of the polymer is in the range 1,000 to 50,000.

4. A process according to claim 1 wherein the substrate is treated by spraying with or by immersion in the acid phosphate solution.

5. An acidic zinc phosphate solution containing a depolarizing oxidant and 1–100 parts of water soluble polymer, per million parts of phosphate solution, said polymer being a polyacrylic acid or a polyacrylamide of molecular weight between 150 and $5 \times 10^5$.

* * * * *